US009770835B2

(12) United States Patent
Eichhorn et al.

(10) Patent No.: US 9,770,835 B2
(45) Date of Patent: Sep. 26, 2017

(54) OSCILLATORY SHAVER

(75) Inventors: Reinhold Eichhorn, Idstein (DE); Detlef Gleich, Friedrichsdorf (DE); Peter Junk, Schmittten (DE); Christof Kleemann, Eschborn (DE); Michael Odemer, Niddatal (DE); Thorsten Pohl, Muehlheim (DE); Tobias Schwarz, Schmitten (DE); Thomas Verstege, Frankfurt am Main (DE); Martin Vitt, Frankfurt am Main (DE); Juergen Wolf, Kriftel (DE); Christoph Zegula, Roedermark (DE)

(73) Assignee: Braun GmbH, Kronberg (DE)

( * ) Notice: Subject to any disclaimer, the term of this patent is extended or adjusted under 35 U.S.C. 154(b) by 391 days.

(21) Appl. No.: 12/348,413

(22) Filed: Jan. 5, 2009

(65) Prior Publication Data

US 2009/0133266 A1 May 28, 2009

Related U.S. Application Data

(63) Continuation of application No. PCT/EP2007/004436, filed on May 18, 2007.

(30) Foreign Application Priority Data

Jul. 5, 2006 (DE) ..... 10 2006 030 946

(51) Int. Cl.
*B26B 19/04* (2006.01)

(52) U.S. Cl.
CPC ..... *B26B 19/048* (2013.01)

(58) Field of Classification Search
CPC ..... B26B 19/00; B26B 19/04; B26B 19/046; B26B 19/048
USPC ..... 30/43.7, 43.8, 43.9, 43.91, 43.92, 42
See application file for complete search history.

(56) References Cited

U.S. PATENT DOCUMENTS

| | | | | |
|---|---|---|---|---|
| 4,400,875 | A * | 8/1983 | Buzzi et al. | 30/43.92 |
| 5,185,926 | A * | 2/1993 | Locke | 30/43.92 |
| 5,257,456 | A * | 11/1993 | Franke et al. | 30/43.92 |
| 5,289,636 | A * | 3/1994 | Eichhorn et al. | 30/43.92 |
| 5,410,811 | A * | 5/1995 | Wolf et al. | 30/43.9 |
| 5,542,179 | A * | 8/1996 | Beutel | 30/43.92 |
| 5,669,138 | A * | 9/1997 | Wetzel | 30/43.92 |
| 6,052,904 | A * | 4/2000 | Wetzel et al. | 30/43.92 |
| 6,205,666 | B1 * | 3/2001 | Junk | 30/43.92 |
| 6,317,984 | B1 * | 11/2001 | Okabe | 30/43.92 |
| 2002/0011003 | A1 * | 1/2002 | Van Hout et al. | 30/43.92 |
| 2004/0163260 | A1 * | 8/2004 | Uchiyama | 30/43.92 |

(Continued)

FOREIGN PATENT DOCUMENTS

| | | |
|---|---|---|
| DE | 1 048 510 | 1/1959 |
| DE | 1 065 298 | 9/1959 |

(Continued)

*Primary Examiner* — Jason Daniel Prone
(74) *Attorney, Agent, or Firm* — Jay A. Krebs; Steven W. Miller

(57) ABSTRACT

A shaving unit for a dry shaver includes at least one outer cutter and one under cutter. Driven by a motor, the outer cutter and the under cutter are movable relative to each other in an oscillatory motion. The under cutter and the outer cutter, which are biased into relative engagement by at least one spring, slide along a common contact surface. The spring is arranged in such a way that its biasing force always acts at an angle to the direction of oscillation.

6 Claims, 5 Drawing Sheets

(56) References Cited

U.S. PATENT DOCUMENTS

| | | | | |
|---|---|---|---|---|
| 2004/0237310 | A1* | 12/2004 | Shiba et al. | 30/43.92 |
| 2009/0025229 | A1* | 1/2009 | Kappes et al. | 30/43.92 |

FOREIGN PATENT DOCUMENTS

| | | |
|---|---|---|
| DE | 1133 276 | 7/1962 |
| DE | 1 553 786 | 4/1970 |
| DE | 2029 664 | 5/1971 |
| DE | 2305 786 | 8/1973 |
| DE | 36 31 120 | 4/1987 |
| DE | 29 49 301 | 2/1990 |
| DE | 195 43 095 | 6/1997 |
| EP | 1 810 797 | 7/2007 |
| GB | 520802 | 5/1940 |
| JP | 54-085860 A | 7/1979 |
| WO | WO00/06348 | 2/2000 |

* cited by examiner

OSCILLATORY SHAVER

CROSS-REFERENCE TO RELATED APPLICATIONS

This application is a continuation application of and claims priority to PCT Application Serial No. PCT/EP2007/004436, filed on May 18, 2007, through which priority is claimed under 35 U.S.C. §119(a) from German patent application number 10 2006 030 946.4, filed Jul. 5, 2006. The entire contents of PCT Application Serial No. PCT/EP2007/004436 are incorporated herein by reference.

TECHNICAL FIELD

This invention relates to oscillatory shavers, such as the type in which relative oscillatory motion is established between an under cutter and an outer cutter, to cut hairs.

BACKGROUND

An oscillatory shaver is described in DE-C 29 49 301, with a shaving assembly that includes a base plate upon which one end of a helical spring is supported while its other end applies pressure to the under cutter and urges it into contact with the shaving foil, which in turn is secured to the base plate. The helical spring stands perpendicularly between the base plate and the under cutter in the mid-position of the shaving assembly. As a result, on each movement of the under cutter relative to the base plate, the helical spring is displaced once to the left and once to the right, overriding each time its perpendicular, maximally compressed initial position. A total of two helical springs are provided, which in the mid-position apply the maximum pressure to the under cutter, whilst in the displaced position they produce a substantially lower contact pressure. In addition, this shaving assembly tends to cause the under cutter to retract at one end as the oscillatory motion reverses its direction.

SUMMARY

One aspect of the invention features a dry shaver shaving unit that has an outer cutter and an associated under cutter, at least one of which is movable relative to the other in an oscillatory motion, in which sliding contact is established between the under cutter and outer cutter along facing contact surfaces. A spring biases the facing contact surfaces into engagement, and is arranged such that throughout the oscillatory motion, the spring produces a biasing force with a first force component acting along the oscillatory motion and a second force component acting perpendicular to the oscillatory motion.

In some embodiments, the spring lies in a longitudinal symmetry plane of the shaving unit. The second force component generally lies in the direction of the main load applied by the user while shaving.

In some configurations, two springs develop respective first force components in opposed relation to each other. The first force components can be, for example, of equal and opposite magnitudes at a center point of the oscillatory motion, for example. As one spring is compressed, the other spring is relaxed. The driving force to be applied by the motor or the driving torque thus tends to remain constant regardless of the actual direction of movement and is conducive to smooth operation. The springs may be configured such that the contact force in the contact area between outer cutter and under cutter is generally constant throughout the oscillatory motion.

In some examples the spring includes a first attachment point on the under cutter and a second attachment point fixed in relation to the outer cutter, with the attachment points not crossing each other in the direction of the oscillation motion during oscillation. The second attachment point of the spring may be an adjustable spring seat. This construction enables a functioning cutter unit to be assembled completely in a prior operation, which then needs to be connected only to the gearing and the drive mechanism. Such a construction is particularly suited for use as a retractable and/or pivotal shaving assembly in which the frame supporting the outer cutter, biased by an elastic element, is slidably carried in the housing of the dry shaver or in a component connected thereto. In this arrangement, the spring ensures at all times reliable engagement between outer cutter and under cutter, while the elastic element determines the retracting or pivoting action in dependence upon the contact pressure applied by the user. A shaver system is thereby provided which conforms optimally to skin contours to be shaved.

In some embodiments, the under cutter includes an engagement surface, such as a shoulder, for adjustment of the spring seat.

In some cases the spring is a compression spring. In some cases, the spring comprises a helical spring.

In some embodiments, the outer cutter is fastened in a frame and the spring has one end that bears against the under cutter and another end that bears against the frame.

In some examples, the oscillating motion is linear. In some examples, the oscillating motion is a rotary or pivotal motion.

These concepts are applicable to both short-hair and long-hair cutter assemblies. Therefore, in some embodiments the outer cutter is constructed to include a shaving foil which cooperates with an under cutter having a plurality of blades, while in another embodiment the outer cutter is constructed to include a comb of a long-hair trimmer that cooperates with an under cutter constructed as a blade having a plurality of cutting teeth.

Another form of the invention features a dry shaver with a housing, a motor accommodated within the housing, and the above-described cutter unit operably connected to the motor to establish the oscillatory motion.

In some cases the frame, biased by an elastic element, is configured to slide within the housing. The elastic element may have, for example, a spring rate lower than a spring rate of the spring.

The concepts described herein can help ensure that during the oscillatory motion the under cutter makes consistently uniform, close contact with the outer cutter. Owing to the spring arrangement, the biasing force acts upon the under cutter always with both a normal force component and a tangential force component in relation to the contact area.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
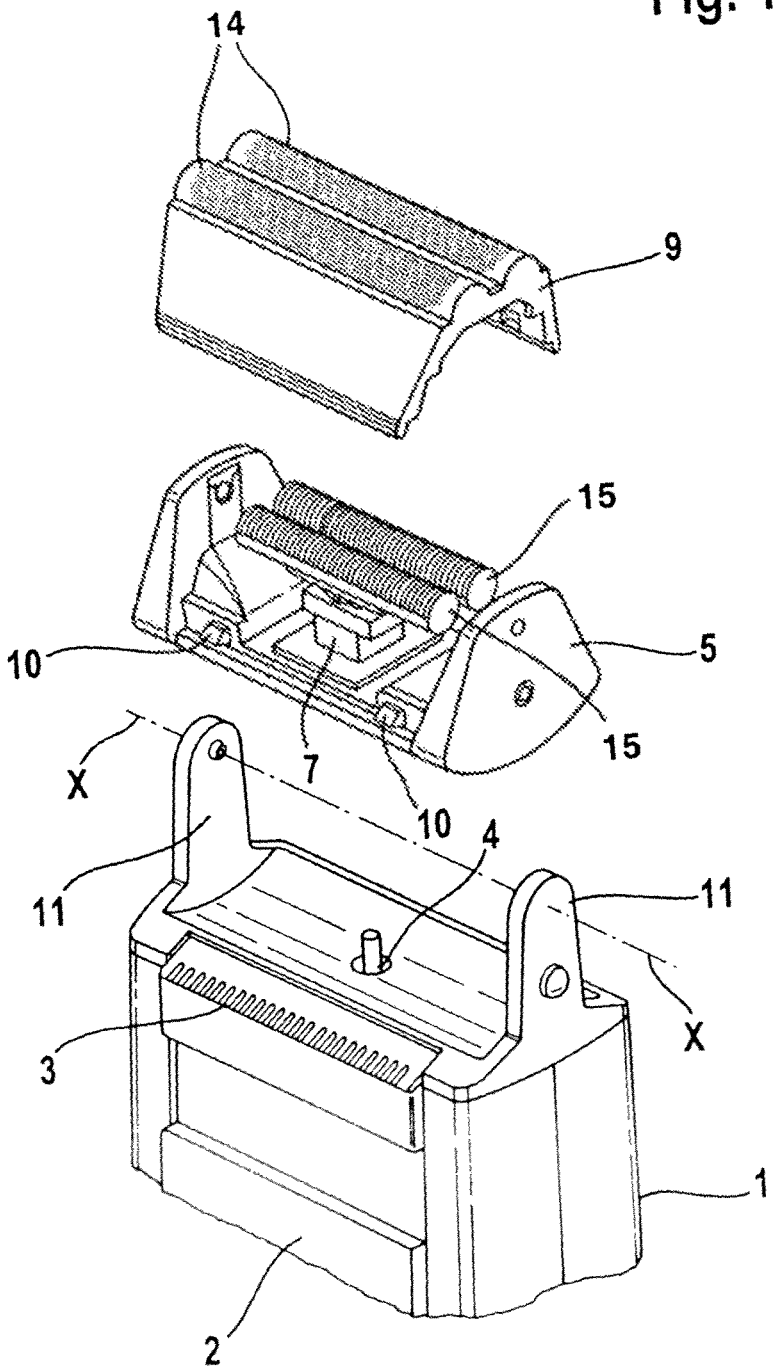
FIG. 1 is a view of the basic construction of a dry shaver.
Figure 2:
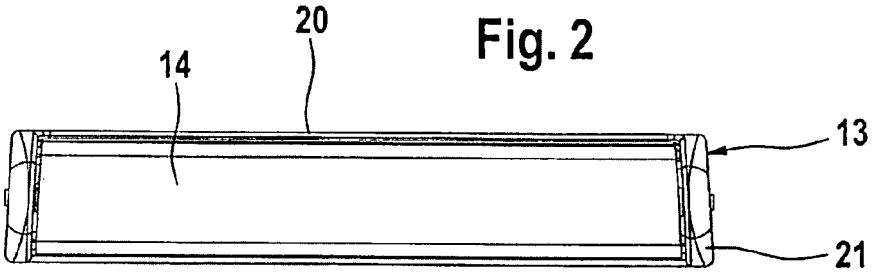
FIG. 2 to FIG. 5 are, respectively, a top plan view, a front view, a side view and a bottom view of a cutter unit.
Figure 3:
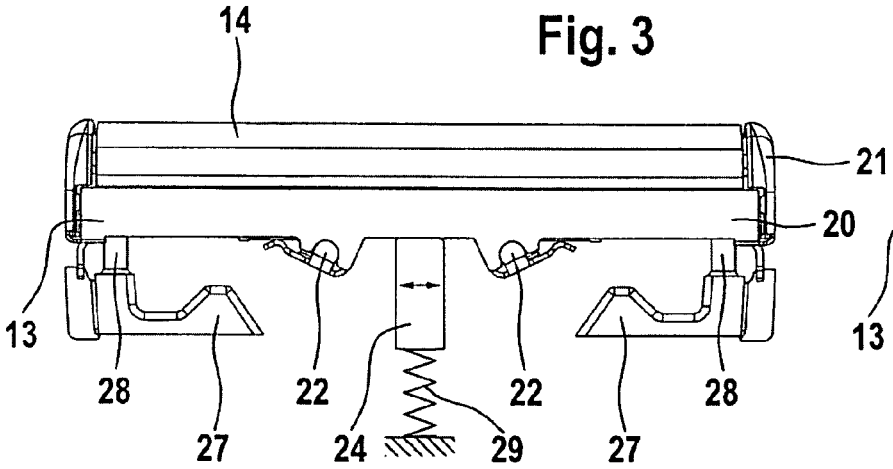
Figure 4:
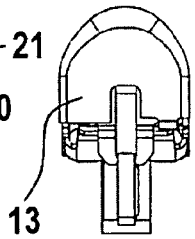
Figure 5:
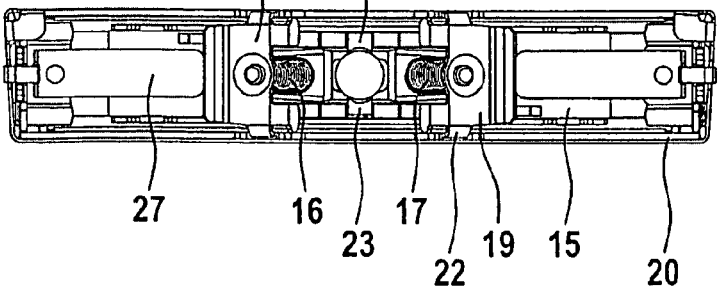

FIG. 1 shows in a perspective representation a dry shaver with a housing 1 accommodating an electric motor and, as the case may be, single-use or rechargeable batteries or the like. Arranged on the housing 1 is an on/off switch [2] and, as the case may be, a trimmer [3] for shortening relatively long hair. Projecting from the upper end of the housing 1 is a drive element 4 that is coupled to the motor.

A shaving head housing 5 receives under cutters [15] which are constructed to include a cutter block having a plurality of blades extending in a direction transverse to the direction of oscillation. The under cutters are held by a coupling element 7, which is in turn connected to the drive element 4. Outer cutters [14], which are constructed as perforated foils, are held in a frame 9 connected to the shaving head housing by catch elements 10. The shaving head housing 5 in turn is mounted on holding arms 11 of the housing 1 for pivotal movement about an axis X-X. With the drive mechanism activated, the under cutters [15] are caused to oscillate along their longitudinal axis and, in cooperation with the outer cutters [14], cut off hairs extending through the perforated foil. To accomplish this, it is necessary for the under cutter [15] to be permanently pressed into engagement with the outer cutter [14].

The shaving unit illustrated in FIGS. 2 to 7 as a modular construction includes a substantially rectangular module frame 13 on which a shaving foil 14 is secured which, shaped to conform to the contour of a cutter block 15, is arched around the latter. The cutter block 15 is pressed into engagement with the shaving foil 14 by two compression springs 16, 17 which are constructed as helical springs. To this effect, the compression springs 16, 17 bear against associated spring seats 18, 19 that extend in bridge fashion between two longitudinal members 20 of the module frame 13 and therefore approximately parallel to end members 21 of the module frame.

Each of the spring seats 18, 19 is equipped with two holding arms 22 that extend with allowance for play into corresponding recesses in the longitudinal members. They are positioned according to the adjustment process subsequently described and firmly joined to their respective longitudinal member by placement of a spot weld. As becomes apparent from FIG. 6 in particular, the cutter block 15 includes a blade section 25 and a cutter support 26, with the blade section 25 including a plurality of individual blades and being made in the form of an arched sheet metal strip provided with transverse slots. The cutter support 26 includes a mount 23 for coupling engagement with a drive element 24 which, with the motor turned on, reciprocates in an oscillatory motion (see FIGS. 3 and 5). The direction of oscillation corresponds to the longitudinal axis of the cutter block 15.

The module frame 13 is mounted on a support element 27 that includes guide pins 28. As becomes apparent from FIG. 3, it is therefore vertically slidable along the guide pins 28. In combination with a supporting spring 29, which acts upon the drive element 24 in longitudinal direction or, alternatively, acts between the module frame 13 and the support element 27, a retractable shaving assembly is provided that conforms itself to given facial contours. The support element 27 is preferably a component part of the pivotal shaving head housing 5 in order to offer both a retracting and a pivoting option for maximum adaptation to the contours of the skin to be shaved, but it can also be a component part of the housing 1. The retracting movement of the shaving assembly in downward direction is limited by the solid length of the supporting spring(s) 28 or a stop 32 on the support element 27. It will be understood, of course, that the upward movement of the shaving assembly may be also limited by suitable stops not illustrated in the drawings.

Figure 6:
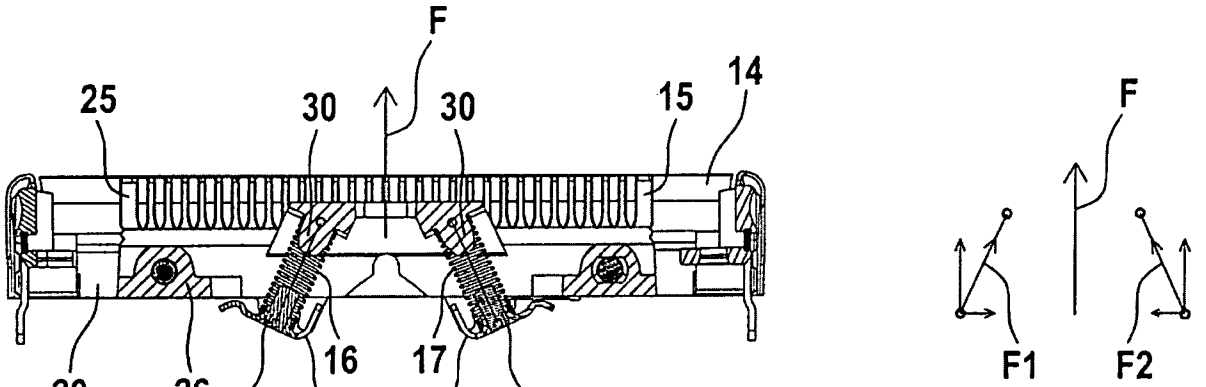
FIG. 6 and FIG. 7 are, respectively, sectional views of the shaving assembly showing the under cutter in different positions.
Figure 7:
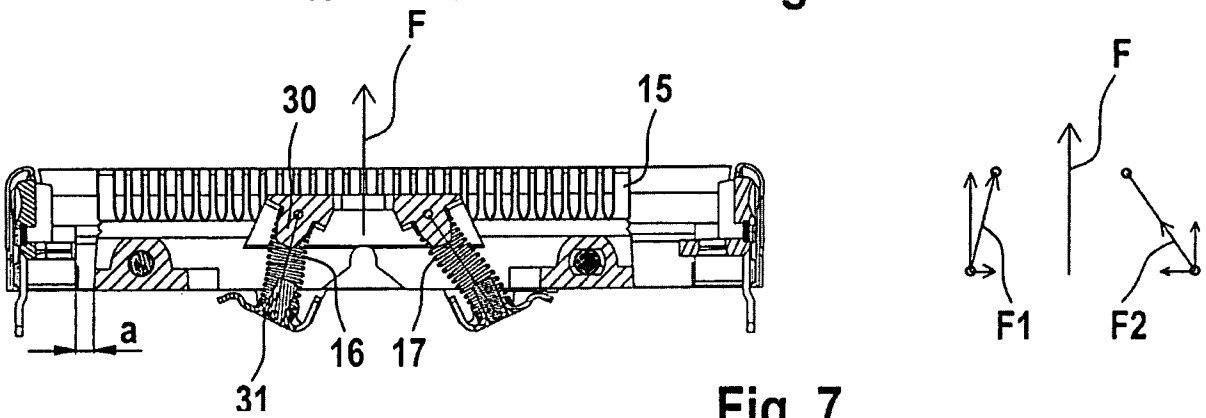

FIG. 6 is a longitudinal sectional view of the shaving unit of the invention in which the under cutter, that is, the cutter block 15, is in a mid-position. In operation, it is moved out of this mid-position about 1.1 mm to the left and to the right, so that the total travel of the under cutter amounts to about 2.2 mm. FIG. 7 shows the under cutter as displaced to the left, with a distance a remaining between the cutter block 15 or its cutter support 26 and the left-hand boundary of the module frame 13.

The two compression springs 16, 17 lying in the longitudinal center plane are arranged in an oblique fashion, that is, in this embodiment their upper ends are inclined toward one another. The distance between their first attachment points 30 associated with the cutter block 15 is therefore substantially smaller than the distance between the second attachment points 31, which are associated with the module frame 13. Given such an orientation of the compression springs 16, 17, at the instant of time when a linear oscillatory motion reverses its direction, the inertia-induced retracting motion of a section of the cutter block 15, which after the reversal is the rear end section, is counteracted. However, a reversed elastic seating arrangement, in which the upper ends of the compression springs 16, 17 are inclined away from each other, is also contemplated.

Both the first attachment points 30 and the second attachment points 31 in the first and second spring seats 18, 19 are constructed as cup-shaped spring mounts that extend into the cylindrical interior space of the helical springs and guide the springs.

FIG. 7 shows the cutter block 15 as moved to the outer extreme of its travel during oscillation, and it will be clearly seen that even in this condition the upper end of the first compression spring 16 still extends obliquely inwardly. Accordingly, the shaving unit is designed in such a way that in any operating condition the first attachment points 30 on the cutter block lie within the space defined by the distance between the second attachment points 31.

In the mid-position (FIG. 6) the acute angle between the horizontal and the respective longitudinal axes of the first and second compression springs 16 and 17 amounts to 65°, approximately. The two forces from the biased compression springs 16, 17 are illustrated next to the Figure as vectors designated as F1 and F2 with associated vertical and horizontal components. The total force resulting from the compression springs in the vertical direction is designated as F and is representative of the engagement force between the cutter block 15 and the shaving foil 14. In the outwardly displaced condition of FIG. 7, the compressive force of the first compression spring 16 increases due to the compression, whereas the force of the second compression spring 17 diminishes. In addition, the outward displacement of the cutter block 15 relative to the module frame 13 or the shaving foil 14 causes a variation of the acute angles between the horizontal and the longitudinal axis of the respective compression springs. The acute angle associated with the first compression spring 16 increases to 75°, approximately, while the acute angle between the longitudinal axis of the second compression spring 17 and horizontal diminishes to 55°, approximately. This causes the variations of the force components F1 and F2 illustrated in the parallelogram of forces shown next to the Figure. As shown in the force diagram, the total force F as sum of the vertical components of forces F1 and F2 in the outwardly displaced position of the cutter block 15 roughly equals the one in the center position. This means that at any point of the oscillatory motion of the cutter block, the engagement force between the cutter block and the shaving foil is essentially constant. The horizontal components, that is, the tangential portions, of forces F1 and F2 are always opposed to one another.

Figure 8:
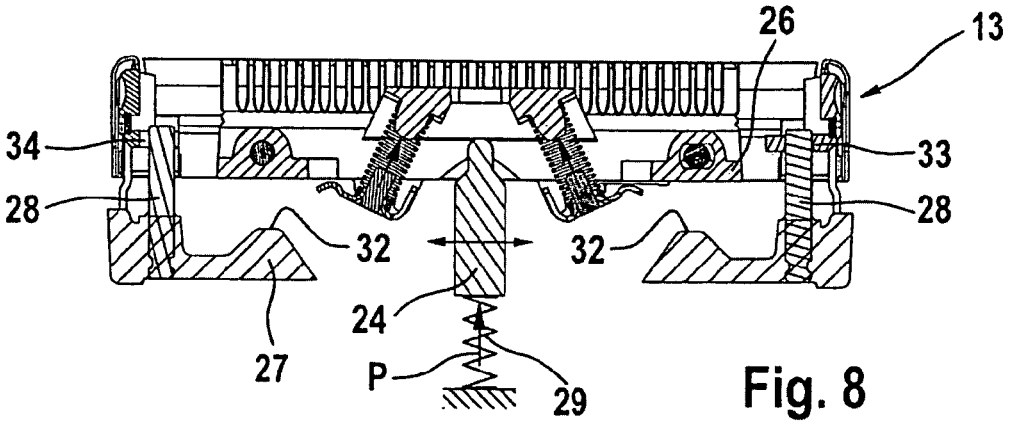
FIG. 8 and FIG. 9 are, respectively, views of a further configuration of a cutter unit, shown in different positions of retraction.
Figure 9:
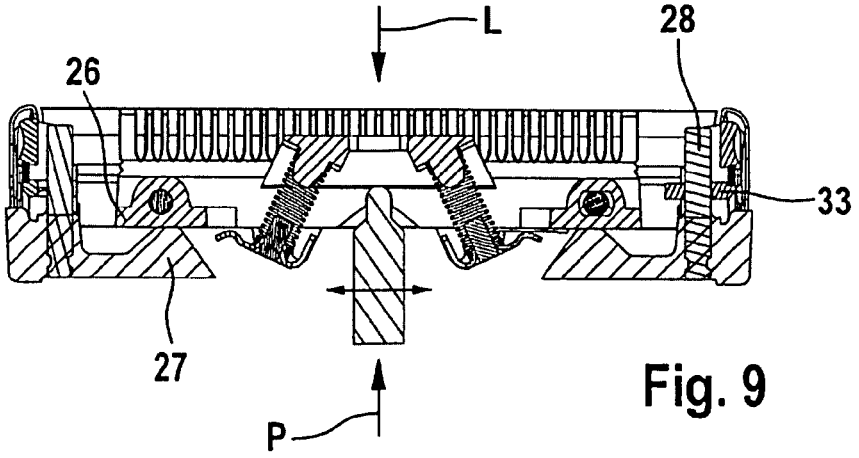

FIGS. 8 and 9 illustrate once again the floating suspension of the module frame 13 including the shaving foil 14 and the cutter block 15 biased by compression springs 16, 17 on a support element 27 by means of guide pins 28. FIG. 8 shows the shaving unit in a completely extended position, that is, with the distance between the support element 27 and the module frame 13 at its maximum. In this position, the distance between the bottom edge of the cutter support 26 of the cutter block 15 and the stop 32 formed on the support element 27 is about 3 mm. The module frame 13 is urged upwardly by the supporting spring 29 acting vertically upon the oscillatory drive element 24 with a pressure P. When a suitable load L is applied, the entire shaving unit is able to recede downwardly until the bottom edge of the cutter support 26 abuts the stop 32 on the support element 27. To make sure that the module frame 13 is able to slide on the guide pin 28 without the risk of jamming, the latter is mounted in fully enclosed fashion on the right-hand side by a guide ring 33, while on the left-hand side a guide fork 34 embraces the left-hand guide pin only in part.

Figure 11:
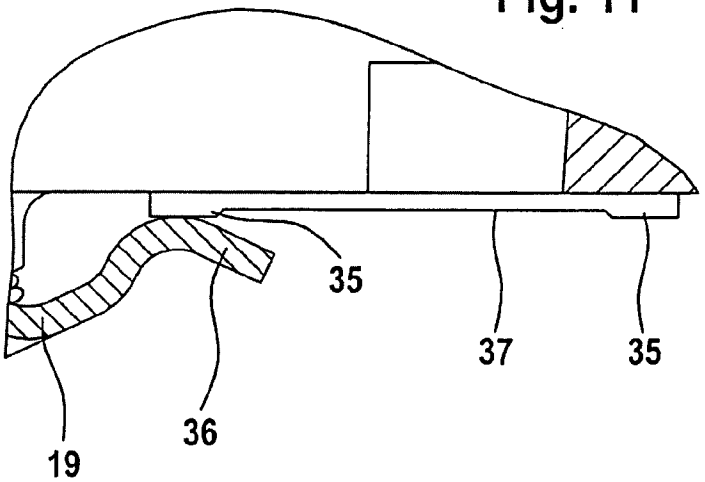
FIG. 10 to FIG. 13 are views illustrating the adjustment process of the spring element of the shaving unit.
Figure 10:
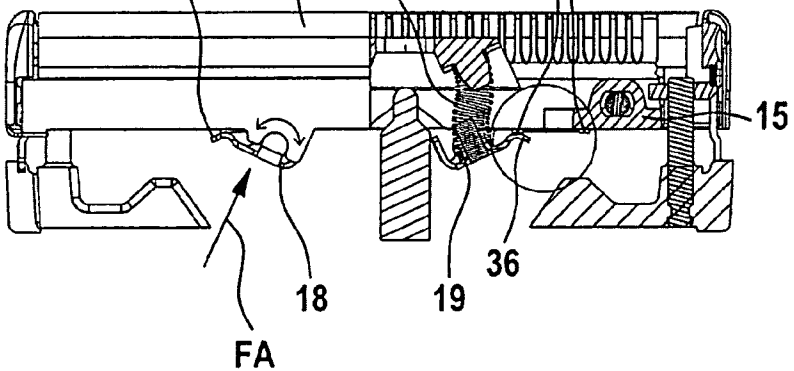
Figure 12:
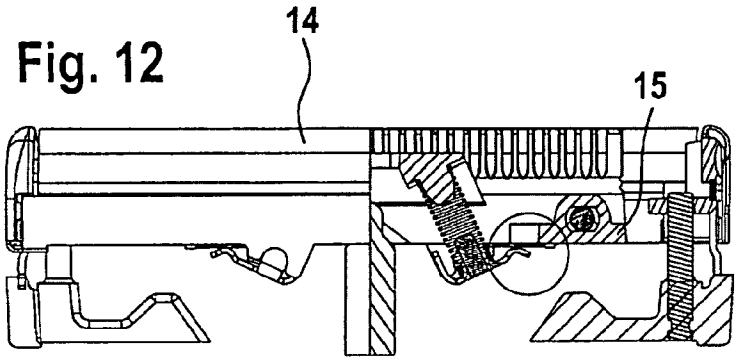

In FIGS. 10 and 12 and their enlarged fragmentary views (FIGS. 11 and 13), the adjustment of the maximum amount of play between the cutter block 15 and the shaving foil 14 or the limiting of the receding movement of the cutter block is depicted in more detail. In FIGS. 10 and 12, for clarity of illustration only the right-hand half of the Figure is shown in section, whereas the left-hand half is a view of the outside of the shaving unit. During assembly of the shaving unit, the operation of fastening the shaving foil 14 to the module frame 13 is followed by the operation of shifting the complete under cutter, i.e., the cutter block 15, sideways beyond the amplitude occurring in operation until abutment with the stop. As a result, the cutter support 26 makes sideways engagement with a component of the module frame 13.

This sideways engagement defines a position which cannot be achieved in operation when the cutter is oscillating. In FIG. 10, the cutter block 15 is illustrated as displaced to the extreme right in abutment with the module frame 13. In this position, one of the shoulders 35 arranged on the cutter support 26 has moved into the area of a bow-shaped end portion 36 of the second spring seat 19. On the underside of each cutter support 26 a total of four shoulders 35 are arranged, two to the left and two to the right of the first and second compression springs 16 and 17, respectively. These shoulders protrude relative to the surface 37 of the cutter support 26 by about 0.03 mm. Surface 37 forms the area that is reciprocated during the oscillatory motion above the spring seats 19 and 18 under operating conditions.

When the described assembly position is reached, that is, the cutter block 15 is displaced longitudinally into abutment with the module frame 13, a defined pressure force FA directed obliquely inwardly is applied to the spring seats 18 and 19. As this occurs, the spring seats—as indicated by the arcuate double arrow—are able to pivot about their axis defined by the holding arms 22. As a result, the spring seats 18 and 19 are urged forcibly against the shoulder 35, and in this position their holding arms 22 are welded to the associated longitudinal member 20. While the end portion 36 of the second spring seat 19 rests against the left-hand or inner one of the two shoulders 35, the corresponding end portion 36 of the first spring seat 18 rests during the adjustment process against the outer one of the two shoulders 35 that are arranged on the left-hand one of the two symmetrical cutter block halves.

Figure 13:
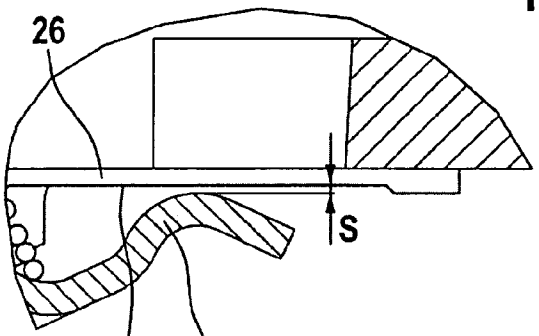

If the cutter block 15 is then shifted back to its mid-position as illustrated in FIGS. 12 and 13, a defined gap S of 0.03 mm is produced between surface 37 of cutter support 26 and spring seats 18 and 19. This dimension S represents the maximum possible retracting movement of the cutter block 15 relative to the module frame. Dimension S is so small that no hair can be drawn into the gap developing maximally between shaving foil 14 and cutter block 15 and be clamped instead of being cut off. This small amount of play between cutter block 15 and shaving foil 14 ensures that the shaving foil cannot lift itself clear of the under cutter under the action of transverse forces occurring during use by loads applied in a direction perpendicular to the longitudinal center plane, such as friction forces.

While a number of examples have been described for illustration purposes, the foregoing description is not intended to limit the scope of the invention, which is defined by the scope of the appended claims. There are and will be other examples and modifications within the scope of the following claims.

What is claimed is:

1. A dry shaver comprising a housing; a motor accommodated within the housing; and a cutter unit comprising an outer cutter and an associated under cutter, at least one of which is movable relative to the other in an oscillatory motion, in which sliding contact is established between the under cutter and outer cutter along facing contact surfaces; and two springs biasing the facing contact surfaces into engagement, the two springs arranged such that throughout the oscillatory motion, the springs produce a biasing force with a first force component acting along the oscillatory motion and a second force component acting perpendicular to the oscillatory motion, wherein the cutter unit is operably connected to the motor to establish the oscillatory motion, and further, wherein the outer cutter is fastened in a frame and each of the two springs has one end that bears against the under cutter and another end that bears against the frame, and wherein the frame, biased by an elastic element, is configured to slide within the housing.

2. The shaving unit of claim 1, wherein the under cutter comprises an engagement surface for adjustment of the spring seat.

3. The shaving unit of claim 1, wherein the two springs comprise a compression springs.

4. The shaving unit of claim 1, wherein the outer cutter is a shaving foil.

5. The shaving unit of claim 1, wherein the outer cutter comprises a comb of a long-hair trimmer.

6. The dry shaver of claim 1, wherein the elastic element has a spring rate lower than a spring rate of the springs.

* * * * *